US005435513A

United States Patent [19]

Davis

[11] Patent Number: 5,435,513

[45] Date of Patent: Jul. 25, 1995

[54] APPARATUS FOR SUSPENDING CONTAINERS IN AN INVERTED POSITION

[76] Inventor: Robert T. Davis, R.R. 2, Moulton, Iowa 52572

[21] Appl. No.: 227,117

[22] Filed: Apr. 13, 1994

[51] Int. Cl.[6] ..... A47K 1/08

[52] U.S. Cl. ..... 248/311.3; 248/340

[58] Field of Search ..... 248/311.3, 309.1, 311.2, 248/340

[56] References Cited

U.S. PATENT DOCUMENTS

| | | | |
|---|---|---|---|
| 2,289,701 | 7/1942 | Engel et al. | 248/311.3 |
| 2,798,230 | 7/1957 | Febvre et al. | 248/311.3 |
| 2,990,080 | 6/1961 | Harris . | |
| 3,391,891 | 7/1968 | Garden | 248/311.3 |
| 3,589,338 | 6/1971 | Lovitz | 248/311.3 |
| 4,150,806 | 4/1979 | Dziuk | 248/311.3 |
| 4,932,624 | 6/1990 | Holm . | |
| 4,957,260 | 9/1990 | Shelley . | |
| 4,969,580 | 11/1990 | Ezzat | 248/311.3 |
| 5,002,246 | 3/1991 | Chaffin et al. | 248/311.3 |
| 5,067,680 | 11/1991 | Miller . | |
| 5,232,137 | 8/1993 | Devine . | |
| 5,269,354 | 12/1993 | Koberg . | |
| 5,301,634 | 4/1994 | Ho | 248/311.3 |

FOREIGN PATENT DOCUMENTS

| | | |
|---|---|---|
| 1039849 | 10/1953 | France . |
| 1216025 | 4/1960 | France . |
| 128443 | 6/1950 | Sweden . |

*Primary Examiner*—David M. Purol
*Attorney, Agent, or Firm*—Zarley, McKee, Thomte, Voorhees, & Sease

[57] ABSTRACT

A device and method for holding a container in an inverted position to assist in dispensing the contents of the container. A bracket and retaining band are doubled along the length of the container. The retaining band holds the bracket into abutment with the container. The bracket has a mounting portion or mechanism that allows the bracket to be hung from or mounted to a supporting structure. The bracket also includes a portion towards the opposite end of the bracket which stabilizes the bracket along the side of the container to resist rotation of the hook. The bracket and retaining band allow suspension of the container in an inverted position for easier dispension of the contents of the container.

1 Claim, 1 Drawing Sheet

APPARATUS FOR SUSPENDING CONTAINERS IN AN INVERTED POSITION

BACKGROUND OF THE INVENTION

A. Field of the Invention

The present invention relates to suspending containers, in particular, to devices and methods by which containers can be suspended in an inverted position to assist in dispensing the contents of the container.

B. Problems in the Art

Nearly everyone has experienced at some point in time difficulty in dispensing the contents of containers such as ketchup or shampoo bottles. This occurs particularly in instances where the substance being dispensed does not flow freely or easily, either as a function of the substance itself or the form and configuration of the container.

A few examples of such substances include ketchup, honey, glue, and shampoo. Many others exist. Each of these substances comes in a form having inherent properties which resist easy flow. By way of another example, such things as ketchup and mustard containers many times have very constricted dispensing openings which further complicates easy dispension of the substance.

Such containers normally are stored with the dispensing opening or mouth of the container upward. The substance in the container therefore usually settles. The more the substance is used, the longer the distance, and thus the more time and effort is required to dispense what remains of the substance. Containers must be manually inverted, shook or manipulated to obtain a sufficient quantity of substance. Many times dispensing lids must be removed and instruments such as knives or spoons must be inserted to remove the substance.

Therefore, a need exists in the art to allow easier dispension of substances from containers. Attempts have been made to deal with these sort of problems. For example, U.S. Pat. No. 5,067,680 to Miller utilizes a tubular holder into which a container can be inserted in an inverted position. The holder is then attached to a wall by suction cups.

U.S. Pat. No. 2,990,080 to Harris discloses a relatively flat base and stopper combination to hold a bottle bearing carbonated beverages in an inverted position.

U.S. Pat. No. 4,932,624 to Holm describes a wall bracket, supporting strut and lever arrangement to support containers in the form of bags in an inverted dispensing position.

U.S. Pat. No. 4,957,260 to Shelley discloses a wall mounting bracket and dispenser for pressurized containers held in an inverted position.

U.S. Pat. No. 5,269,354 to Koberg discloses a rack for inverting multiple motor oil containers in an inverted position so that they can be drained into another container.

U.S. Pat. No. 5,232,137 to Devine discloses a bracket to hold a spray can on an individual's belt for easy access.

French Patent 1,216,025 discloses in its drawings what appears to be a flexible cord that is fashioned to be placeable around a bottle to suspend it in an inverted position.

Swedish Patent 128,443 appears to illustrate a bracket that can mount a bottle having a wire or rope handle in an inverted position to a wall.

French Patent 1,039,849 discloses what appears to be a wire bracket for substantially inverting glass bottles.

Each of the above-identified patents relates in one manner or the other to the inverting of containers. However, they either utilize rigid and one-size mounting sleeves, holders, or brackets, represent substantially complex structure with a variety of parts, or relate to functions that are different than the task of inverting and holding a container for dispension of its contents.

It is therefore a principal object of the present invention to provide an apparatus and method for suspending a container to assist in dispension of its contents which improves over the art or solves the problems in the art.

Another object of the present invention is to provide an apparatus and method as above described which is adaptable to a wide variety of sizes and shapes of containers.

A still further object of the present invention is to provide an apparatus and method as above described which is substantially smaller in size than the range of containers with which it can be used.

Another object of the present invention is to provide an apparatus and method as above described which is not complex to manufacture, use, or maintain.

Another object of the present invention is to provide an apparatus and method as above described which is economical to manufacture and to use.

A still further object of the present invention is to provide an apparatus and method as above described which is effective and durable.

These and other objects, features, and advantages of the present invention will become more apparent with reference to the accompanying specification and claims.

SUMMARY OF THE INVENTION

The present invention relates to an apparatus and method for suspending different size and shape containers in an inverted position to assist in dispensing substances inside the containers.

A band is utilized to surround the container along its length. A bracket member is associated with the band and has members which allow connection of the band so that the bracket is held in abutment to the surface of the container. A hook or other connection member extends from the bracket to allow the bracket and the container being held by the band to be suspended from a supporting structure. A portion of the bracket extends below a general plane defined by the around the container and on an opposite side from the hook to stabilize the bracket against the container when it is suspended.

DETAILED DESCRIPTION OF THE PREFERRED EMBODIMENT

Figure 1:
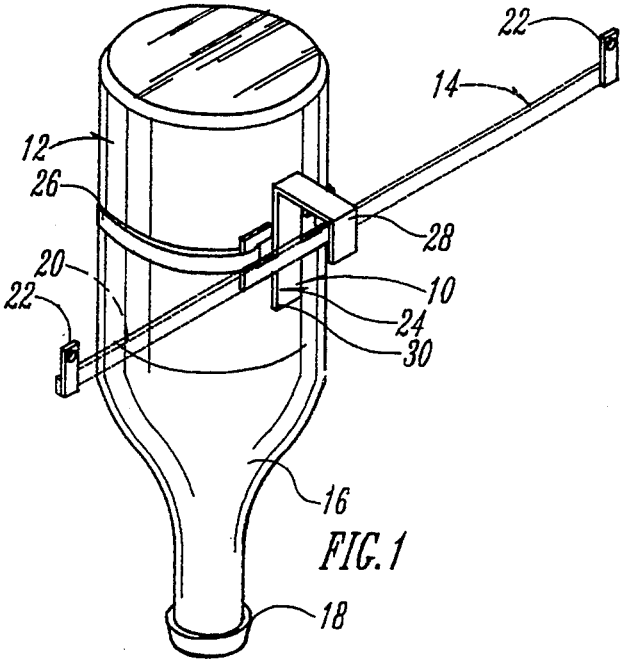
FIG. 1 is a perspective view of a preferred embodiment of the invention shown in use with a container and suspended from a supporting structure.

A preferred embodiment according to the present invention will now be described in detail. It is to be understood that this is but one form the invention can take and does not and is not intended to limit the scope of the invention.

The drawings will be referred to frequently in this description. Reference numerals will be used to indicate certain parts and locations in the drawings. The same reference numerals will be used to indicate the same parts and locations throughout all the drawings unless otherwise indicated.

FIG. 1 illustrates an apparatus 10 according to the present invention in association with a bottle or container 12 and a supporting structure or bar 14.

Bottle 12 in FIG. 1 is similar to a ketchup bottle or shampoo bottle. To illustrate operation of the invention, bottle 12 is shown as transparent. A substance 16 (for example, ketchup or shampoo) is shown inside bottle 12. A lid or dispensing cap 18 is shown secured to the mouth of bottle 12. As is well known, lid 18 can be any of a variety of types. For example, it could be a screw on cap or it could be a hinged lid. Similarly, bottle 12 could be rigid such as made of glass, or flexible such as made of plastic.

In FIG. 1, bar 14 is simply an elongated rod 20. It could include mounting flanges 22 to allow rod 20 to be mounted to a wall or other structure. As can easily be understood, a variety of other types of supporting structures could be utilized with the invention 10.

As can be seen in FIG. 1, apparatus 10 consists of a bracket (denoted generally at reference number 24) and a band 26. In this embodiment, 26 comprises a simple rubber band which can be looped at opposite ends and expanded to fit around bottle 12, so that bracket 24 is held in abutment with a surface of bottle 12. The rubber band resiliently contracts and by virtue of its inherent characteristics, holds bracket 24 in place as shown in FIG. 1, and prevents bracket 24 or itself from moving along bottle 12.

FIG. 1 shows that a hook portion 28 of bracket 24 is used to hang bracket 24 from bar 14. A stabilizer portion 30 extends oppositely from the bottom of bracket 24 and serves to prevent rotation of hook 28.

In this manner, bottle 12 can be held in an inverted position so that substance 16 flows to lid 18 and therefore will immediately be available at lid 18 for dispensing.

Figure 2:
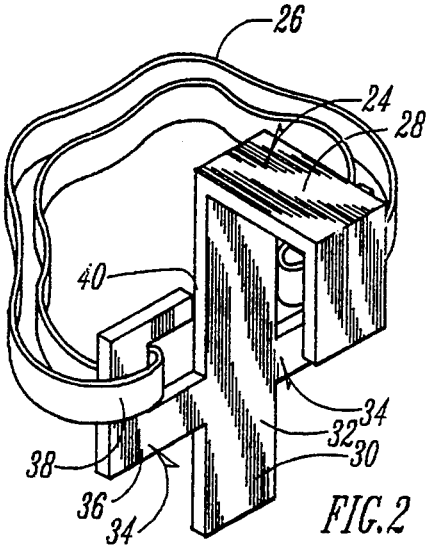
FIG. 2 is an enlarged perspective view of the invention of FIG. 1 isolated from the container and supporting structure.
Figure 4:
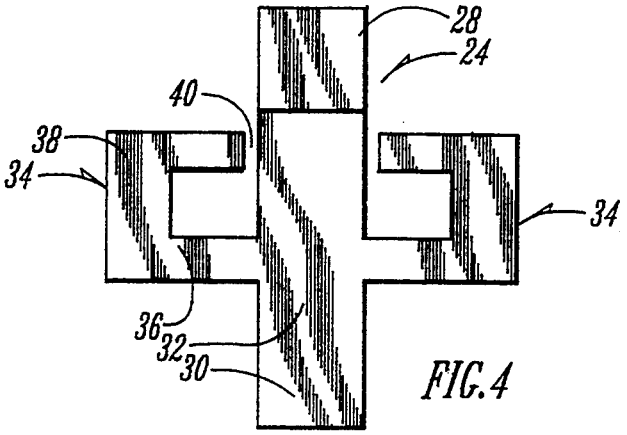
FIG. 4 is a back elevational view of FIG. 2 without the retaining.
Figure 3:
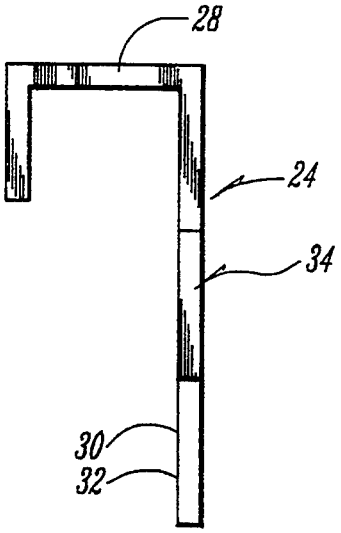
FIG. 3 is a side elevational view of the embodiment of FIG. 2 without the retaining.

FIGS. 2–4 show bracket 24 in isolated and enlarged fashion. FIG. 2 illustrates how band 26 connects to bracket 24. In this embodiment what will be called base 32 consists of an elongated portion between hook 28 and stabilizer portion 30. Two arms 34, in this embodiment basically mirror images of one another, each have a first portion 36 extending transversely from longitudinal axis of the base and a second L-shaped portion 38 that extends basically parallel to the longitudinal axis of base 32 and then back towards base 32. A small gap 40 exists between the distal end of each arm 34 and base 32.

As shown in FIG. 2, band 26 is looped over gaps 40 and around arms 34 so that bracket 24 holds the loops of band 26 in place. Two strands of band 26 thus surround container 12. Band 26 can be a rubber band. Such an arrangement therefore provides double-strength by the double wrap of the band. The combination of band 26 and bracket 24 can then be manipulated over bottles or containers 12 of various shapes and configurations.

FIGS. 3–4 show various views of bracket 24 of FIG. 2. It is to be understood that the size, shape, and configuration of bracket 24 or any of its parts, can vary. For example, hook 28 can take on a variety of different configurations depending on what sort of hooking or hanging function is required. The size and shape of arms 34 can also vary according to need or desire. The precise dimensions of base 32 including stabilizing portion 30 can also vary.

Figure 5:
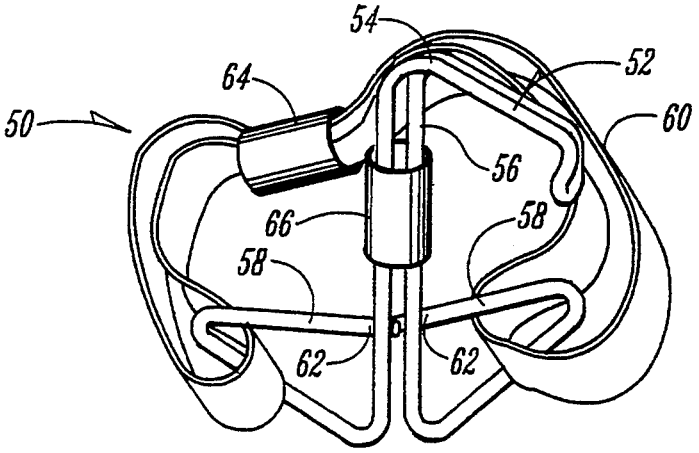
FIG. 5 is a perspective view of an alternative embodiment according to the present invention.

FIG. 5 illustrates another possible embodiment according to the present invention. In this case apparatus 50 consists of a wire bracket 52 that is folded into configuration having a hook 54, a middle portion 56, and arms 58. Rubber band 60 can be manipulated over ends 62 of bracket 52 so that it is retained in arms 58. To give the configuration stability, more rigidity, and easier functionality, a tube 64 can be placed over the middle of band 60 and a tube 66 can be placed over the middle portion 56 of bracket 52. Otherwise, apparatus 50 functions essentially like apparatus 10. It is to be understood that arms 58 are configured so that when band 60 is stretched around a bottle 12 (not shown), the plane generally defines a plane around bottle being held. Hook portion 54 would be above that plane and the lower portions of arms 58 would be below that plane thus effectively functioning to stabilize apparatus 50 on the bottle like stabilizer portion 30 of apparatus 10 of FIG. 1.

It will be appreciated that the present invention can take many forms and embodiments. The true essence and spirit of this invention are defined in the appended claims, and it is not intended that the embodiment of the invention presented herein should limit the scope thereof.

It is to be understood that these embodiments have been discussed with regard to bottles which contain substances of relatively high viscosity such as shampoo or ketchup. It is to be understood, however, that the invention can be used with containers holding any type of substance whether solid, liquid, or gas, if desired.

Also the hook described in the preferred embodiment could alternatively be simply an arm with an aperture or opening through which a screw, bolt of other hooking or mounting device could be attached. Other mounting or connecting structure could be utilized.

What is claimed is:

1. An apparatus to suspend a container comprising:

a base member of substantially rigid material;

a connection member positioned along the base member;

a mounting member connected to the base member on one side of the connection member;

a stabilizer member connected to the base member on the opposite side of the connection member; and the connection member comprising first and second arms each having a portion extended away from the base member and a return portion terminating at a distal end near the base member, and a gap between the return portion and the base member through which a retaining member can be looped.

* * * * *